US011232690B2

(12) United States Patent
Shepard

(10) Patent No.: US 11,232,690 B2
(45) Date of Patent: Jan. 25, 2022

(54) MULTIPURPOSE ALERT SYSTEM FOR SMOKE, FIRE, NATURAL GAS, AND/OR CARBON MONOXIDE

(71) Applicant: Michael Shepard, Shiocton, WI (US)

(72) Inventor: Michael Shepard, Shiocton, WI (US)

( * ) Notice: Subject to any disclaimer, the term of this patent is extended or adjusted under 35 U.S.C. 154(b) by 0 days.

(21) Appl. No.: 17/169,657

(22) Filed: Feb. 8, 2021

(65) Prior Publication Data

US 2021/0287509 A1 Sep. 16, 2021

Related U.S. Application Data

(60) Provisional application No. 62/989,842, filed on Mar. 15, 2020.

(51) Int. Cl.

| | |
|---|---|
| ***G08B 17/10*** | (2006.01) |
| ***G08B 7/06*** | (2006.01) |
| ***G08B 21/16*** | (2006.01) |
| ***G08B 21/14*** | (2006.01) |

(52) U.S. Cl.
CPC ..... *G08B 17/10* (2013.01); *G08B 7/06* (2013.01); *G08B 21/14* (2013.01); *G08B 21/16* (2013.01)

(58) Field of Classification Search
CPC ..... G08B 17/10; G08B 21/16; G08B 21/01
See application file for complete search history.

(56) References Cited

U.S. PATENT DOCUMENTS

| | | | | |
|---|---|---|---|---|
| 5,563,578 | A * | 10/1996 | Isenstein | G08B 17/117 340/521 |
| 9,030,329 | B2 * | 5/2015 | Rutherford | G01D 4/002 340/632 |
| 10,508,822 | B1 * | 12/2019 | Sheikh | G05B 15/02 |
| 2005/0200492 | A1 * | 9/2005 | Woodard | G08B 21/14 340/632 |
| 2014/0111343 | A1 * | 4/2014 | Kim | G08B 17/10 340/628 |
| 2015/0228419 | A1 * | 8/2015 | Fadell | H04L 12/2834 307/112 |
| 2018/0051901 | A1 * | 2/2018 | Saintellemy | H04L 12/6418 |
| 2018/0060153 | A1 * | 3/2018 | Innes | G06F 11/30 |
| 2019/0318598 | A1 * | 10/2019 | Aponte Luis | G08B 21/22 |
| 2019/0325724 | A1 * | 10/2019 | Kim | G08B 17/10 |

* cited by examiner

*Primary Examiner* — Ojiako K Nwugo
(74) *Attorney, Agent, or Firm* — Brennan, Manna & Diamond, LLC

(57) ABSTRACT

The present invention relates to a multipurpose alert system for smoke, fire, natural gas, and/or carbon monoxide specially designed for elderly and hard-of-hearing individuals. The multipurpose alert system of the present invention is capable of sending emergency alerts notifying a user, a user's family, emergency medical services, and other individuals of the presence of smoke, natural gas leaks, fire, and/or carbon monoxide leaks. In addition, the multipurpose alert system may notify as user via a plurality of flashing displays, a wearable vibration device, an audible alarm, a SMS/text message, an email, or a phone call. Finally, the multipurpose alert system may be used as a standalone detector, be comprised of a plurality of additional detectors, or be used in conjunction with existing detectors of fire/smoke/natural gas/carbon monoxide.

13 Claims, 4 Drawing Sheets

MULTIPURPOSE ALERT SYSTEM FOR SMOKE, FIRE, NATURAL GAS, AND/OR CARBON MONOXIDE

CROSS-REFERENCE TO RELATED APPLICATION

The present application claims priority to, and the benefit of, U.S. Provisional Application No. 62/989,842, which was filed on Mar. 15, 2020 and is incorporated herein by reference in its entirety.

FIELD OF INVENTION

The present invention relates generally to the field of smoke, natural gas, carbon monoxide and fire detection systems. More specifically, the present invention relates to a multipurpose alert system for smoke, fire, natural gas, and/or carbon monoxide that is specifically designed for use by elderly and hard-of-hearing individuals. The alert system of the present invention is capable of sending emergency alerts to one or more of a user, the user's family, emergency medical services, and other individuals upon detecting the presence of smoke, natural gas, fire and/or carbon monoxide. Additionally, the alert system may notify a user via a plurality of flashing displays, a wearable vibration device, an audible alarm, an SMS/text message, an email, or a phone call. The alert system may be used as a standalone detector or may be comprised of a plurality of detectors. It may also be used in conjunction with existing fire, smoke, natural gas and/or carbon monoxide detectors. Accordingly, the present disclosure makes specific reference thereto. Nonetheless, it is to be appreciated that aspects of the present invention are also equally applicable to other like applications, devices and methods of manufacture.

BACKGROUND

Various emergency detection devices, such as smoke detectors, carbon monoxide detectors, fire detectors and other hazard detectors, are widely used by individuals in residences and in commercial buildings to rapidly detect emergency situations such as fires, smoke, carbon monoxide and natural gas leaks, or the like. By way of background, existing smoke detectors detect smoke, oftentimes from a fire, and alert the individual the a possible fire incident within the home or other commercial building or structure. By comparison, a carbon monoxide detector detects the presence of harmful carbon monoxide (CO) gas to prevent carbon monoxide poisoning, which is otherwise undetectable by an individual. Still other emergency hazard detection devices may be used to detect the presence of harmful substances in the air and/or to detect the occurrence of any hazardous chemical or material present, for example, as the result of a spill. Each of these hazard detection systems then typically inform a user or other folks present in the vicinity by triggering an audible alarm such that the user and others present may take the necessary steps to evacuate the structure and/or reduce the loss and damage that could be caused by smoke/fire to their belongings. The sound of such devices and their characteristics, such as volume, pitch and alarm sound pattern among other settings, are oftentimes predefined by the user in order to easily distinguish the hazard or emergency indicative alarm sound from other common household or alarm sounds.

Unfortunately, not all sound-based alarms can be heard by elderly individuals or those individuals who have suffered hearing loss or are deaf. As such, these individuals may have difficulty in determining when a smoke/fire, emergency and/or carbon monoxide alarm has been activated and signals an emergency via an audible alarm. Without a further type of notification or notifying means, these hard-of-hearing individuals may be unaware that the alarm has even been activated or the occurrence or of an emergency. As a result, these individuals and their respective property are placed at substantial risk because of their inability to hear an audible alarm.

Therefore, there exists a long felt need in the art for a smoke, fire, natural gas, and/or carbon monoxide detector and alarm system which effectively notifies the elderly and those individuals who are deaf or hard-of-hearing of a potential emergency. There is also a long felt need in the art for a smoke, fire, natural gas, and/or carbon monoxide detector and alarm system which generates both an audible alarm and at least one additional notification that can further warn an individual of the current emergency. Additionally, there is a long felt need in the art for a smoke, fire, natural gas, and/or carbon monoxide detector and alarm system which rapidly detects the occurrence of fire, smoke, natural gas, or carbon monoxide in a home or commercial building and informs the user and others (e.g. family members and emergency medical personal) of the emergency to prevent the loss of property and lives of individuals, wherein the individual notified does not need to be physically present in front of the device to view the visual alarm mechanism of the device. Finally, there is a long felt need in the art for a smoke, fire, natural gas, and/or carbon monoxide detector and alarm system which is relatively inexpensive to manufacture and that is both safe and easy to use.

The subject matter disclosed and claimed herein, in one embodiment thereof, comprises a multipurpose alert system for smoke, fire, natural gas, and/or carbon monoxide leaks. The alert system is comprised of a notification device having a plurality of sensors that detect when hazards such as smoke, heat (e.g. fire), carbon monoxide, and/or natural gas are present above an established threshold value, and then provide a redundant notification to the user of the potentially dangerous condition. Alternatively, the alert system may be in electrical communication with an existing smoke, fire, carbon monoxide and/or natural gas detector via a wired or wireless connection, and notifies the user of events detected by said existing detectors. In a further embodiment, the device may also be in electrical communication with a smart device, telephone, computer, router, modem, etc. to send and receive alerts to users, family members of users, and emergency services via an SMS/text message, a pre-recorded phone call, an email or a mobile application.

In this manner, the novel multipurpose alert system for smoke, fire, natural gas, and/or carbon monoxide of the present invention accomplishes all of the forgoing objectives, and provides a relatively safe, easy, convenient and effective solution to notify the elderly, the hard of hearing, or deaf people of the occurrence of emergency situations, such as fire, smoke, natural gas and carbon monoxide leaks. The multipurpose alert system for smoke, fire, natural gas, and/or carbon monoxide of the present invention is also user friendly, inasmuch as it does not require the user to be present in front of the notification device to be alerted of the potential emergency. The device may also provide remote notifications to users, family members of users and emergency personal in an automated fashion.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a multipurpose alert system for smoke, fire, natural gas, and/or carbon monoxide. The device is preferably comprised of a relatively lightweight and fireproof body or housing and a plurality of internal sensors that include, but are not limited to, a carbon monoxide sensor, heat sensor, natural gas sensor and a smoke sensor that are each configured with a threshold value by the user, wherein the values can be observed in real time via a display positioned on the housing or body. Once the threshold value of smoke, heat, carbon monoxide or natural gas has been exceeded by one or more of the sensors, the device may automatically alert a user, local emergency services, and other specified users (e.g. family members, building owners, friends, etc.) via an SMS, text message and/or a phone call. The device will also issue a second or redundant alert to the user that the threshold has been reached or exceeded via an audible alarm, a rapid flashing of the device display, a wearable vibration device or a plurality of additional display devices.

The alert system may be used as a standalone detector device, or can be used in conjunction with one or more of an existing smoke, carbon monoxide, natural gas and/or fire detector. For example, in one embodiment the alert system may be comprised of the device and at least one additional smoke, carbon monoxide, natural gas and/or fire detector that is in electrical communication with the device via a wired or wireless connection means. The alert system may also further connect to an internet providing device (e.g., a computer, telephone, router, modem, smart device, etc.) via an ethernet/LAN cable, an existing detector or a separate detector via, for example, a 3.5 mm or other suitable cable. In addition, the device of the system may also be comprised of an adhesive bottom surface, mounting bracket or hook that allows the device to be positioned on a surface such as a table, or mounted to a wall or other location.

In summary, the multipurpose emergency alert system provides audio, visual, and wearable notifications to elderly, deaf and hard-of-hearing individuals in a manner that is not present by any devices known in the art. Further, the alert system ensures that other important individuals, such as emergency medical personal, family members, building and property owners and the like are promptly notified of any impending or occurring fire, carbon monoxide leak, natural gas leak, etc. In addition, the alert system can easily be used with existing carbon monoxide, natural gas, smoke and fire detectors for easy installation, or can be used on its own as a standalone device.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
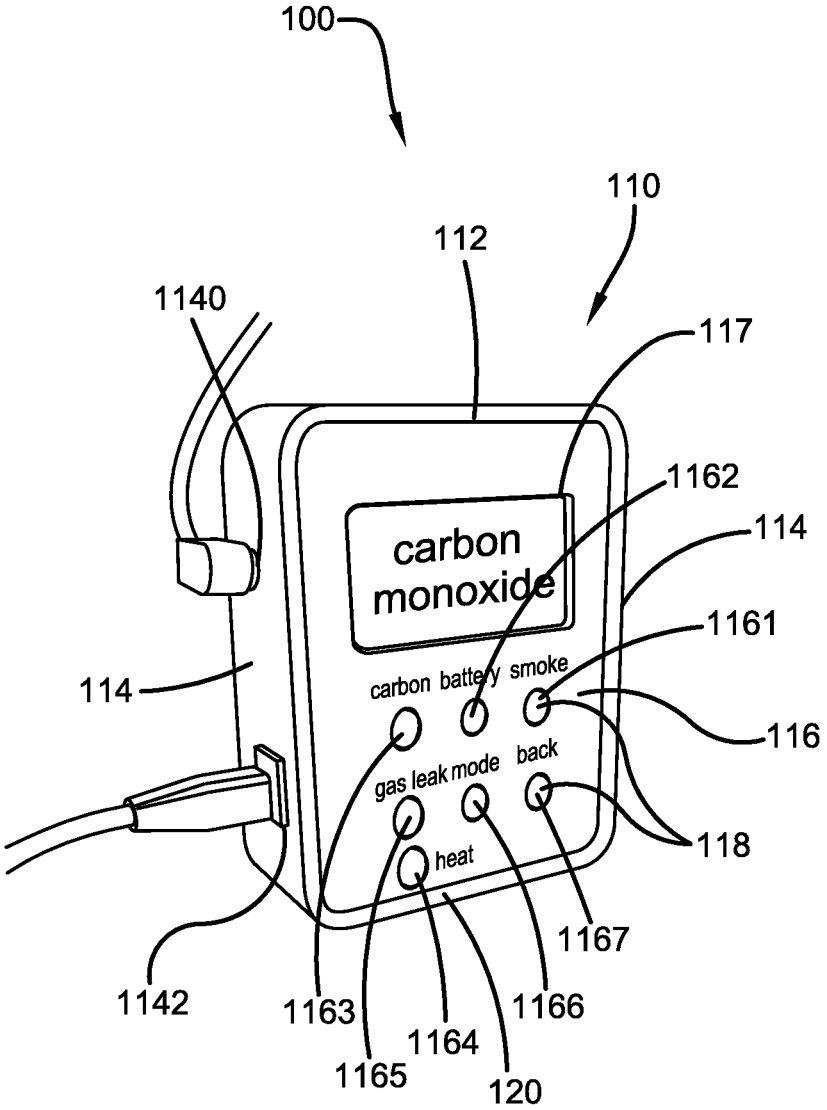
FIG. 1 illustrates a perspective view of one potential embodiment of a multipurpose alert system for smoke, fire, natural gas, and/or carbon monoxide of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a smoke, fire, natural gas and/or carbon monoxide detector and alarm system that effectively notifies elderly, hard-of-hearing or deaf individuals of the presence of a fire, smoke, or a natural gas/carbon monoxide leak via a sound alarm, as well as an additional redundant notification means in the event that the sound alarm does not alert the individual. Additionally, there is a long felt need in the art for a smoke, fire, natural gas and/or carbon monoxide detector and alarm system that rapidly detects the occurrence of a fire or the presence of smoke, natural gas or carbon monoxide in a home or commercial building, and that informs not only the user but others (e.g., friends, neighbors, family members, emergency medical personal and the like) to prevent the loss of life and/or property damage, wherein the individuals are remotely notified in a manner that does not require the individual to be physically present in front of the device to view the notification.

The present invention, in one exemplary embodiment, is comprised of a smoke, fire, natural gas, and carbon monoxide detector and alert system. The device is comprised of a body or housing having a plurality of internal sensors that include, but are not limited to: a carbon monoxide sensor, heat sensor, natural gas sensor and smoke detector. Each of said sensors and detectors may be programmed by the user with a threshold value, and observed in real time via a display screen on the exterior of the device body or housing. Once the threshold value of smoke, heat, carbon monoxide or natural gas has been detected, the alert system will automatically alert a user, local emergency services (e.g. fire, police, medical), and other specified users (e.g. family members, friends, neighbors, caretakers, building owners, etc.) via an SMS, text message, and/or automated phone call. The alert system may also alert a user that the threshold was reached via an audible alarm, a rapid flashing of at least one device display or a wearable vibration device. The alert system may be used as a standalone device or may be comprised of at least one additional accompanying smoke, fire, carbon monoxide, natural gas detector that can be elsewhere mounted in a house or other building and linked to the alert system via a wired or wireless means.

Referring initially to the drawings, FIG. 1 illustrates a perspective view of one potential embodiment of a multipurpose alert system 100 for smoke, fire, natural gas, and/or carbon monoxide of the present invention in accordance with the disclosed architecture. More specifically, the system 100 is preferably comprised of a generally square or rectangular body or housing 110 having a front surface 116 with a display screen 117 thereon, a plurality of buttons 118 used to control various functions of the system 100, two generally parallel and spaced apart side surfaces 114 that may be further comprised of a 3.5 mm audio jack 1140 and a LAN/Ethernet port 1142, a top surface 112, a bottom surface 120 and rear surface (not shown).

The housing or body 110 is preferably comprised of a durable, relatively lightweight and fire-proof material and is preferably square or rectangular in shape. However, in differing embodiments of the system 100, the body 110 may be comprised of any other non-geometric or geometric shape including, but not limited to, a rectangle, circle, oval, trapezoid, triangle, diamond-shape, etc.

Figure 2:
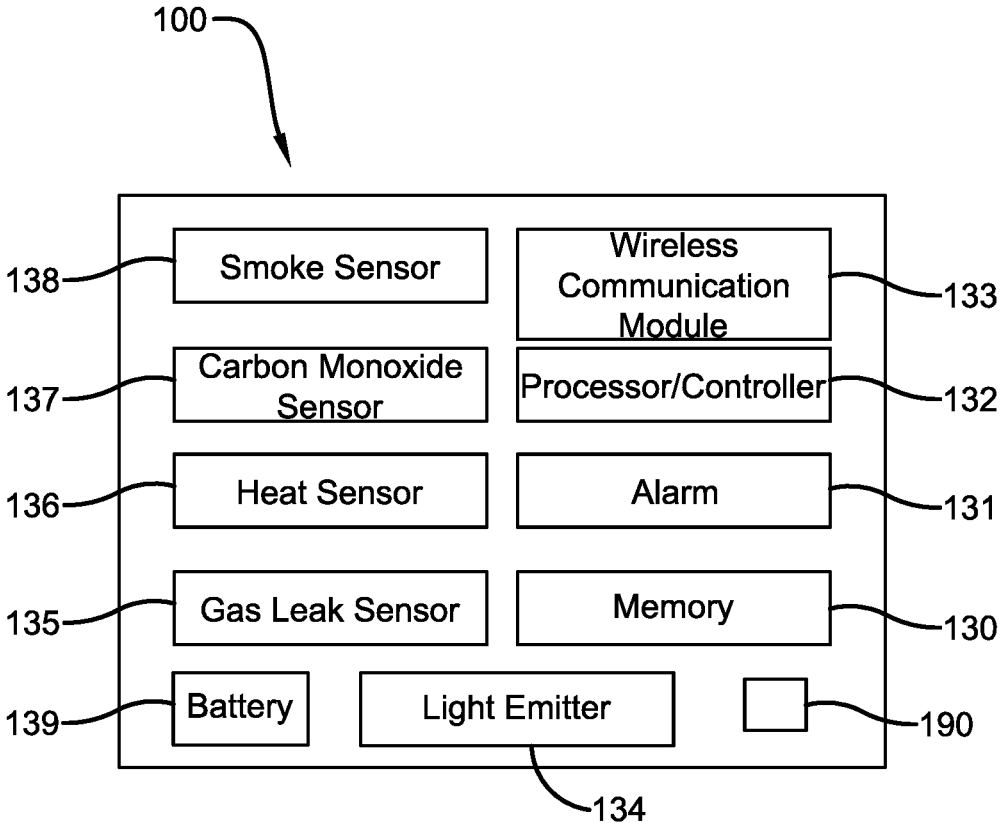
FIG. 2 illustrates a block diagram showing the various components present in one potential embodiment of the multipurpose alert system for smoke, fire, natural gas, and/or carbon monoxide of the present invention in accordance with the disclosed architecture.

FIG. 2 illustrates a block diagram showing the various components present in one potential embodiment of the multipurpose alert system 100 for smoke, fire, natural gas and/or carbon monoxide of the present invention in accordance with the disclosed architecture. More specifically, the components may include a memory 130, an alarm 131, a processor/controller 132, a wireless communication module 133, one or more lights/light emitters 134, a natural gas leak sensor 135, a heat sensor 136, a carbon monoxide sensor 137, a smoke detector 138 and a battery 139.

The memory 130 allows a user to store his or her settings, preferences and the threshold values for each of the sensors and detectors, wherein the alarm 131 will be triggered if one or more of the sensors/detectors detect a value in excess of the threshold value. The processor/controller/circuit board 132 serves as the "brains" of the system 100 and allows the differing functions of the system 100 to be controlled by the user and to function as intended. The wireless communication module 133 allows the system 100 to communicate via Wi-Fi, Bluetooth, RFID, NFC, cellular data, etc. with a smart device such as a user or loved one's phone 170, or a separate smoke, fire, natural gas and/or carbon monoxide detector 160 that may be used in conjunction with the alert system 100, as will be explained more fully below.

Each of the natural gas leak sensor 135, heat sensor 136, carbon monoxide sensor 137 and smoke detector 138 are used to detect a potential emergency and are in electrical communication with one or more of the memory 130, alarm 131, processor 132 and/or the wireless communication module 133. Each sensor/detector 135, 136, 137, 138 may further be pre-programmed or configured by the user to contain a threshold value (or may pull it from the memory 130) of carbon monoxide in parts per million, a smoke threshold that is measured by a photoelectric sensor, a heat sensor that is measured in degrees Fahrenheit/Celsius, and natural gas sensor that measures the amount of natural gas present in the surrounding air, such that when a detected value exceeds one or more threshold values, the alarm 131 notification means of the system 100 is triggered to alert a user and others, as discussed more fully below.

As previously stated, the front surface 116 of the body portion is comprised of a display screen 117 and a plurality of control buttons 118. In differing embodiments of the system 100, the display screen 117 may be comprised of a full color, partial color or black and white screen, wherein the screen may be any of a touch screen, an LCD screen, an OLED screen, an ELD screen, an LED backlit LCD screen, an LED screen, a PDP screen, etc. The display 117 also preferably displays the selected mode, battery status and detected values of each of the carbon monoxide, smoke, heat and natural gas detected by the various sensors 135, 136, 137, 138.

Each of the sensors 135, 136, 137, 138 may further correspond to a particular mode of the system 100, wherein the system 100 may be adjusted to detect for only a specified element (e.g. heat, natural gas, smoke or carbon monoxide), more than one element or all elements. The various modes may be selected via a user pressing one of a plurality of buttons 118 positioned along the front surface 116. The buttons 118 may include, but are not limited to, a smoke sensor button 1161, a battery button 1162, a carbon monoxide sensor button 1163, a heat sensor button 1164, a natural gas sensor button 1165, a mode selection button 1166 and a back button 1167. Each of the smoke sensor button 1161, carbon monoxide sensor button 1163, heat sensor button 1164 and natural gas sensor button 1165 allows the user to select which sensor or sensors are activated at any given time within the system 100. Further, the mode selection button 1166 allows the user to select and create a combination of active sensors 135, 136, 137, 138 that can be recorded in the memory 130, such that switching the mode of the system 100 automatically activates or deactivates all or a partial amount of the sensors 135, 136, 137, 138. Further, the mode button 1166 also allows the user to input a plurality of threshold values for each of sensors 135, 136, 137, 138 as noted above, which will then trigger the alarm 131 when a particular threshold value assigned to a particular sensor 135, 136, 137, 138 is reached or exceeded. The back button 1167 allows the user to navigate back to the previous mode selected, or navigate within an internal menu which can be viewed via the display 117 to allow, for example, the system 100 to connect to a plurality of other devices, as described more fully below.

Figure 3:
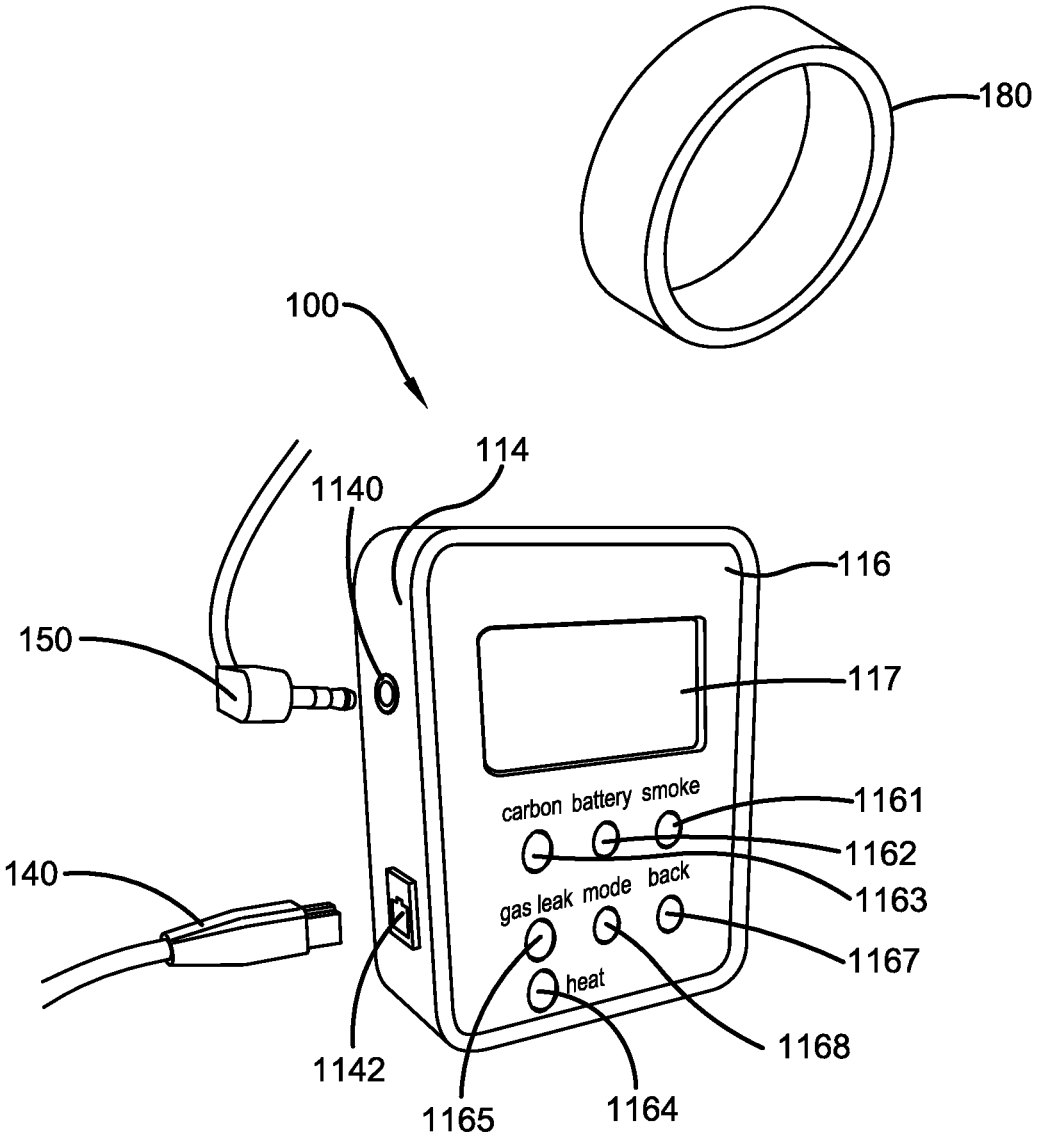
FIG. 3 illustrates a perspective view of one potential embodiment of a multipurpose alert system for smoke, fire, natural gas, and/or carbon monoxide of the present invention in accordance with the disclosed architecture, wherein the system is capable of receiving an LAN cable and/or an auxiliary cable.

FIG. 3 illustrates a perspective view of one potential embodiment of a multipurpose alert system 100 for smoke, fire, natural gas and/or carbon monoxide of the present invention in accordance with the disclosed architecture, wherein the system 100 is capable of receiving a LAN cable 140 and/or an auxiliary cable 150. For example, one of side surfaces 114 of the housing 110 may be comprised of a female 3.5 mm jack port 1140 and/or a female LAN/Ethernet port 1142 to allow the alert system 100 to connect to a standalone carbon monoxide/smoke detector 160, a landline phone, an ethernet port of a router/modem/computer, a smart device, an existing natural gas detector, etc. via a male LAN cable 140 or 3.5 mm cable 150, as will be discussed more fully below. Notwithstanding, it is also contemplated that both of side surfaces 114, the top surface 112, the front surface 116, the bottom surface 120 or the rear surface may also be comprised of a female 3.5 mm jack 1140 or the female LAN port 1142. Additionally, any surface 112, 114, 116, 118, 120 of the body portion 110 may further be comprised of an alternative means to connect the alert system 100 to an existing and standalone carbon monoxide, smoke/fire, natural gas detector, etc. or to a landline phone, an ethernet port of a router/modem/computer or a smart device in the form of a USB port (not shown) that may be comprised of, but not limited to, a USB-A port, USB-B port, Micro-B port, Micro-USB port, Mini-USB port or a USB-C port.

Further, the alert system 100 may be charged/powered via the same USB port, or by battery 139. In differing embodiments of the alert system 100, the battery 139 may be comprised of batteries such as, but not limited to, a disposable battery or a rechargeable battery in the form of an alkaline, nickel-cadmium, nickel-metal hydride battery, etc. such as any 3V-12 volt DC battery or other conventional battery such as A, AA, AAA, etc. or coin-battery that can be accessed via a removable cover (not shown) that may comprise a surface of the housing 110. Throughout this specification the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. Further, in a differing embodiment, the alert system 100 may be powered by a continuous 9 v/12 v power supply that engages a charging port (not shown) on any surface of the body 110.

Figure 4:
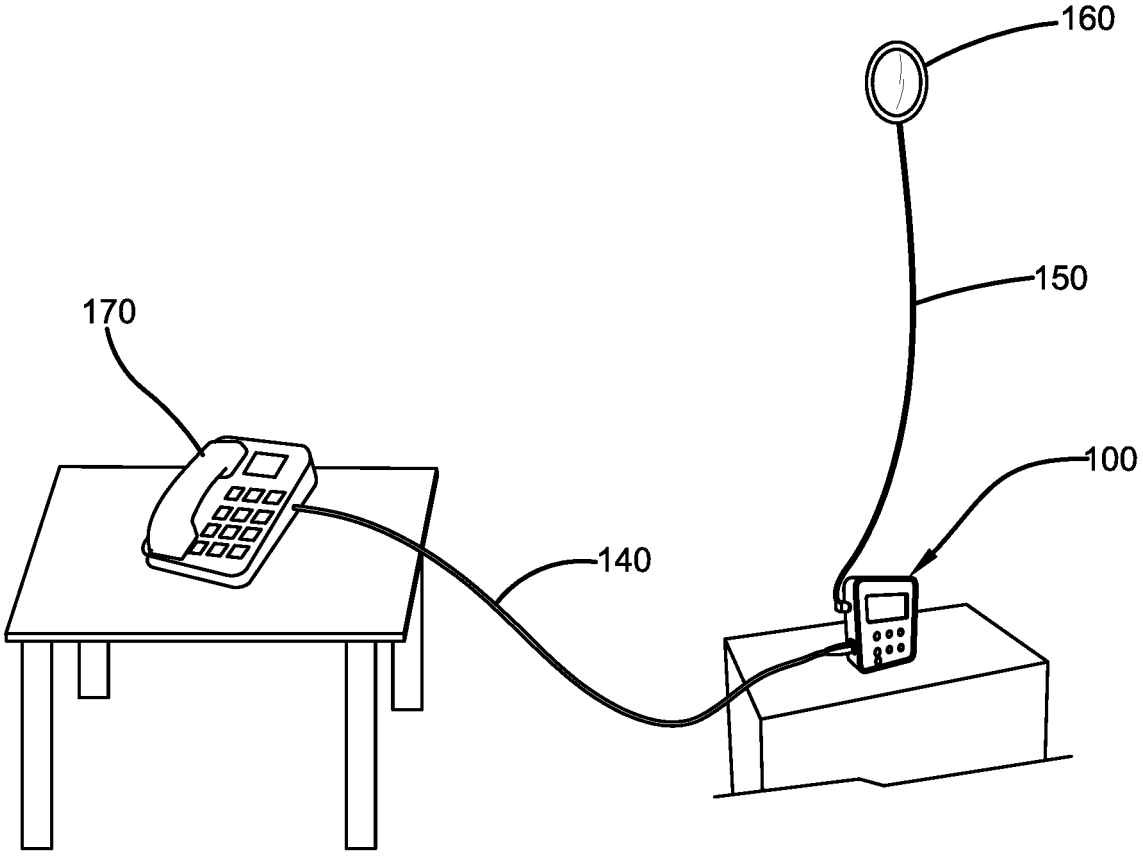
FIG. 4 illustrates a perspective view of one potential embodiment of the multipurpose alert system for smoke, fire, natural gas, and/or carbon monoxide of the present invention in accordance with the disclosed architecture, wherein the system is hardwired to both an existing smoke detector and a telephone.

FIG. 4 illustrates a perspective view of one potential embodiment of the multipurpose alert system 100 for smoke, fire, natural gas, and/or carbon monoxide of the present invention in accordance with the disclosed architecture, wherein the alert system 100 is hardwired to both an existing smoke detector 160 and a telephone 170. As previously stated above, the alert system 100 may be used on its own as a natural gas, heat, smoke, and carbon monoxide detector via its internal sensors 135, 136, 137, 138. Alternatively, the alert system 100 may be used in conjunction with a phone/smart device 10, a device such as a computer/router/modem (not shown), and/or at least one additional external smoke/carbon monoxide/fire/natural detector 160. For example, using the 3.5 mm cable 150, the alert system 100 can be attached to and placed in electrical communication with one or a plurality of existing smoke/carbon monoxide/fire/natural gas detectors, or any type of heat, fire, natural gas or other detector. Alternatively, the alert system 100 and the device 160 may communicate through a wireless communication module 133. Similarly, the alert system 100 may also use an internet connection to communicate with a computer, router, modem or telephone 170. In this manner, the alert system is able to automatically alert a user, emergency services (e.g. police, medical, and fire), and any other designated individuals (e.g. family members, friends, caregivers, neighbors, building owners, etc.) when one, some, or all of the sensors' 135, 136, 137, 138 thresholds have been reached. The alert or notification may be in the form of an SMS/text message, email, or an automatically generated phone call with a pre-recorded message. Further, the alert may be audio-based in the form of a loud sound, siren, audible warning message, etc. that is broadcast via a speaker (not shown) that is also part of the alert system 100.

As noted above, the alert system 100 also comprises a plurality of LED lights 134 that may rapidly flash to alert a user to an emergency. In addition, the display 117 may also flash rapidly as an alert. In a differing embodiment of the alert system 100, the system 100 may also be comprised of a plurality of additional display panels/units 117 that are in electrical communication with the system 100 via a wired or wireless Bluetooth, Wi-Fi, NFC, or RFID connection, wherein the various displays 117 may be positioned or mounted in various places within a structure so that a user can further be alerted by the plurality of rapidly flashing displays 117 and/or LED lights 134 in the event that the user is not directly in front of the central display 117 mounted on the housing 110.

As best shown in FIG. 3, in a further embodiment the alert system 100 may also comprise a vibrating bracelet 180 or necklace (not shown) that is in electrical communication with the device 100 via a Bluetooth, Wi-Fi, NFC, or RFID connection and that vibrates when the threshold of one of the sensors 135, 136, 137, 138 is triggered in order to alert the user to an emergency. In still a further embodiment, the alert system 100 may be paired with a mobile application on a phone 170 that automatically alerts a user, the user's designated friends and family members or emergency services via a notification once the threshold level of one or more of the sensors 135, 136, 137, 138 is triggered. Finally, the alert system 100 may be comprised of a GPS transmitter 190 that automatically transmits the location of the housing 110 when the alert threshold has been reached.

Notwithstanding the forgoing, the multipurpose alert system for smoke, fire, natural gas, and/or carbon monoxide 100 of the present invention can be of any suitable size and configuration as is known in the art without affecting the overall concept of the invention, provided that it accomplishes the above-stated objectives. One of ordinary skill in the art will appreciate that the size, configuration and material of the multipurpose alert system 100 as shown in the FIGS. are for illustrative purposes only, and that many other sizes and shapes of the multipurpose alert system 100 are well within the scope of the present disclosure. Although the dimensions of the multipurpose alert system 100 are important design parameters for user convenience, the multipurpose alert system 100 may be of any size that ensures optimal performance during use and that suits the user's needs and preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A multipurpose alert system comprising:

a fireproof housing;

a display;

a memory;

an alarm configured to provide an audible alert, a visual alert, and an alert communication to a remote alert device;

a processor;

a wireless communication module;

a first device comprising a smoke detector;

a second device comprising a carbon monoxide detector;

a third device comprising a heat sensor; and a fourth device comprising a natural gas leak detector; and wherein any combination of the first, second, third, and fourth devices may be activated simultaneously.

2. The multipurpose alert system as recited in claim 1, wherein each of the smoke detector, the carbon monoxide detector, the heat sensor and the natural gas leak detector has a threshold value.

3. The multipurpose alert system as recited in claim 2, wherein the threshold is selected by a user.

4. The multipurpose alert system as recited in claim 2, wherein the alarm is triggered when the threshold value is achieved or exceeded.

5. The multipurpose alert system as recited in claim 1 further comprising a battery and a plurality of LED lights.

6. The multipurpose alert system as recited in claim 5, wherein the battery is a rechargeable battery.

7. The multipurpose alert system as recited in claim 1 further comprising a plurality of ports for receipt of a power cord, a LAN cable and an auxiliary cable.

8. A multipurpose alert system comprising:

a housing;

a display;

an alarm comprising an audible sound, a visual indicator, and a communication to a remote alert device;

a processor;

a wireless communication module;

a photoelectric smoke detector;

a carbon monoxide detector;

a heat sensor;

a natural gas leak detector; and a mode selector configured to create a combination of activated and deactivated detectors; and wherein the multipurpose alert system is connectable to a separate smoke, heat, or carbon monoxide detector via a physical connector.

9. The multipurpose alert system as recited in claim 8, wherein each of the smoke detector, the carbon monoxide detector, the heat sensor and the natural gas leak detector has a threshold value.

10. The multipurpose alert system as recited in claim 9, wherein the alarm is triggered when the threshold value is achieved or exceeded.

11. The multipurpose alert system as recited in claim 10, wherein the threshold is selected by a user.

12. The multipurpose alert system as recited in claim 8 further comprising a battery, a plurality of LED lights, and a plurality of ports for receipt of a power cord, a LAN cable and an auxiliary cable.

13. A multipurpose alert system comprising:

a housing;

a display attached to an exterior surface of the housing;

an alarm comprising an audible sound, a visual indicator, and a communication to a wearable remote alert device;

a processor positioned within the housing;

a wireless communication module positioned within the housing;

a smoke detector having a first threshold value selected by a user;

a carbon monoxide detector having a second threshold value selected by the user;

a heat sensor having a third threshold value selected by the user; and a natural gas leak detector having a fourth threshold value selected by the user, wherein the alarm is triggered if any of the first, second, third or fourth threshold values are achieved or exceeded; and a mode selector configured to create a combination of activated and deactivated detectors; and wherein the alarm wirelessly sends the communication to the wearable remote device if any of the first, second, third or fourth threshold values are achieved or exceeded.

* * * * *